United States Patent [19]

Riedel

[11] 4,139,213

[45] Feb. 13, 1979

[54] SKI BRAKE

[75] Inventor: Tilo Riedel, Eching, Fed. Rep. of Germany

[73] Assignee: S.A. Establissements Francois Salomon & Fils, Annecy Haute-Savoie, France

[21] Appl. No.: 781,447

[22] Filed: Mar. 25, 1977

[30] Foreign Application Priority Data

Mar. 26, 1976 [DE] Fed. Rep. of Germany ..... 2613016

[51] Int. Cl.[2] ..... A63C 7/10

[52] U.S. Cl. ..... 280/605

[58] Field of Search ..... 280/605, 604; 188/5

[56] References Cited

U.S. PATENT DOCUMENTS

| | | | |
|---|---|---|---|
| 3,715,126 | 2/1973 | Schwarz | 280/605 |
| 3,909,024 | 9/1975 | Salomon | 280/605 |
| 3,989,271 | 11/1976 | Riedel | 280/605 |

FOREIGN PATENT DOCUMENTS

| | | | |
|---|---|---|---|
| 349911 | 12/1960 | Switzerland | 280/605 |
| 2408941 | 9/1975 | Fed. Rep. of Germany | 280/605 |

*Primary Examiner*—David M. Mitchell

*Attorney, Agent, or Firm*—Karl F. Ross,

[57] ABSTRACT

A ski brake comprises a wire pivoted on the support plate of a safety ski binding and displaceable from a rest position extending parallel to the ski to a braking position extending transverse thereto when one of the clamps of the ski binding disconnected from the skiboot and slides on the ski. To this end a guide may be mounted on the clamp and a formation on the brake element is engaged in this guide so as to automatically displace the brake element into the braking position when the skiboot is released. It is also possible to form two braking elements of a single springy wire extending through one of the clamps of the ski binding and otherwise pivoted on the support plate of the ski binding for automatic displacement of the ski brake into the braking position when a boot is released.

7 Claims, 9 Drawing Figures

SKI BRAKE

CROSS-REFERENCE TO RELATED APPLICATIONS

This application is related to my copending application Ser. No. 666,232 filed Mar. 12, 1976; Ser. No. 678,706 filed Apr. 20, 1976; Ser. No. 707,453 filed July 21, 1976; Ser. No. 712,957 filed Aug. 9, 1976 and Ser. No. 712,958 filed Aug. 9, 1976, whose entire disclosures are herewith incorporated by reference.

BACKGROUND OF THE INVENTION

The present invention relates to a ski brake. More particularly this invention concerns such a ski brake usable on a ski having a ski binding provided with a toe clamp and a heel clamp for securing a skiboot to the ski.

Ski brakes are known which normally constitute a brake element that pivots from a rest position parallel to the ski into a braking position perpendicular or transverse to the ski wherein the brake element can dig into snow under the ski and stop forward movement of the ski. Such ski brakes are usually added to the binding structure after its mounting on the ski, or constitute wholly separate assemblies which must be painstakingly interfitted with the ski binding clamps.

Thus the ski brake assemblies according to the prior art are usually bulky and expensive items which considerably increase the cost of the skiing hardware. Furthermore these devices are not in any way integrated with the other structure of the ski so that they merely constitute bulky additions to known skiing equipment.

SUMMARY OF THE INVENTION

It is therefore an object of the present invention to provide an improved ski brake.

Yet another object is to provide a brake which is neatly integrated into a ski binding so that it does not greatly increase the cost of the ski binding or bulk thereof.

These objects are attained according to the present invention in a ski brake having a ski element pivotal as described above between a rest and a brake position and operated directly by the displaceable part of the toe or heel clamp of the ski. Thus when the clamp part, for instance of the heel clamp, is longitudinally displaced on the ski from the release position disengaged from a skiboot to the hold position securing the skiboot to the ski the elongated braking element is automatically displaced into the braking position, and vice versa. Thus in accordance with the present invention the entire assembly is fully integrated and the ski brake hardly adds to the cost of the ski binding. Furthermore the use of one of the clamp parts directly to actuate the brake element represents a considerable saving in mechanism and complexity so that sure operation is obtained.

According to this invention the brake element is pivoted on the ski and is operated by the slidable clamp part. A guide may be provided on the brake element or the clamp part coacting with a formation on the other of these two members so as automatically to pivot the brake element between its end positions on longitudinal displacement of the heel clamp between its end positions. The guide may be provided on the clamp part and constituted either as a pair of pins between which engages a curved end of the brake element constituting the formation, or as a channel open backwardly receiving a pin constituting the formation. Alternately the formation may be a slot on the brake element and the guide may be a pin on the heel clamp received in this slot.

It is also within the scope of this invention to provide a U-shaped leaf-spring member which has one end engaged with the support part of the heel clamp and another end engaged with the formation on the end of the brake skiing element.

Furthermore in accordance with this invention a single spring-steel wire may have a pair of U-shaped end sections each of which constitutes a respective braking element. The free ends of the wire are pivoted in the support plate and the bight section of the wire is supported in the clamp part so as this element moves back and forth the spring-steel wire is moved from the braking to the rest positions. This wire is prestressed into the braking position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
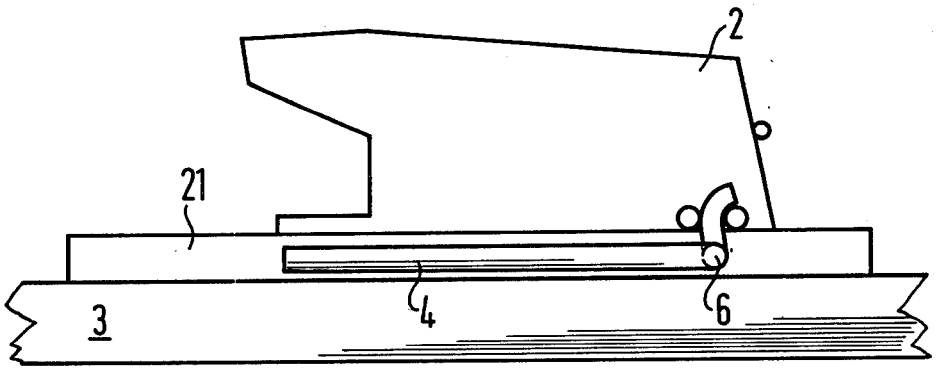
FIGS. 1 and 2 are side views of a first embodiment of the brake according to this invention.
Figure 2:
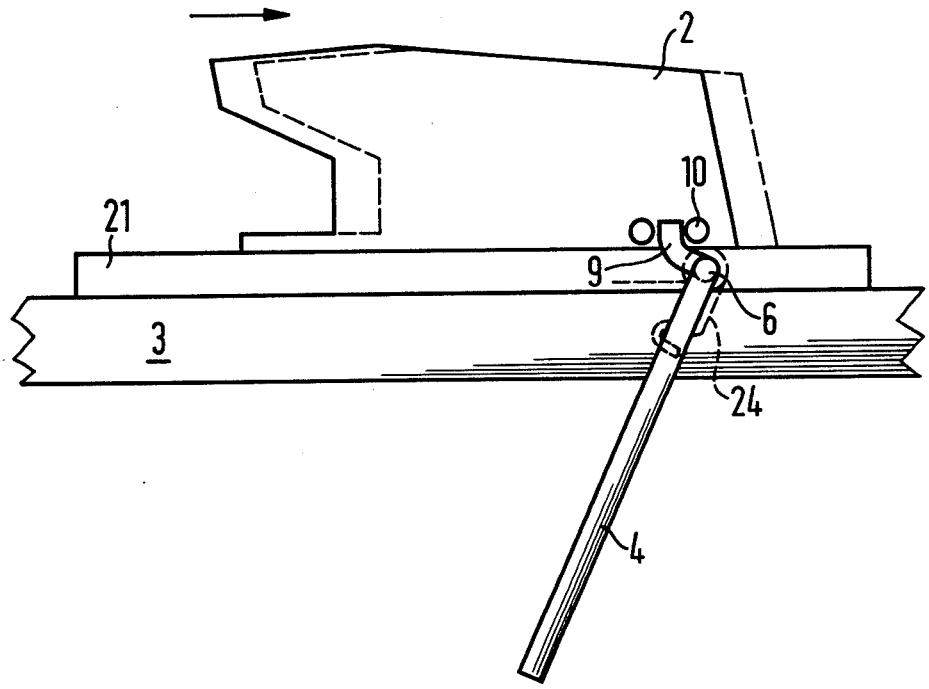

As shown in FIGS. 1 and 2 a ski brake is adapted to be mounted on a ski 3 behind a heel clamp 2 having a support plate 21 fixed to the ski. The ski brake comprises a straight wire braking element 4 having a laterally extending pivot 6 received in the support plate 21 and formed with an arcuately bent upstanding end 9 engaged between two guide pins 10 carried on the heel clamp 2. A torsion spring 24 engages the element 4 and normally urges it into the braking position shown in FIG. 2.

When the heel clamp 2 is moved backwardly into the holding position of FIG. 1 the braking element 4 is pivoted upwardly so as to extend forwardly from the pivot 6 and parallel to the ski 3. Release of the heel clamp 2 causes it to move forwardly as shown in FIG. 2 and allows the spring 24 to displace the brake element 4 downwardly into the braking position.

Figure 3:
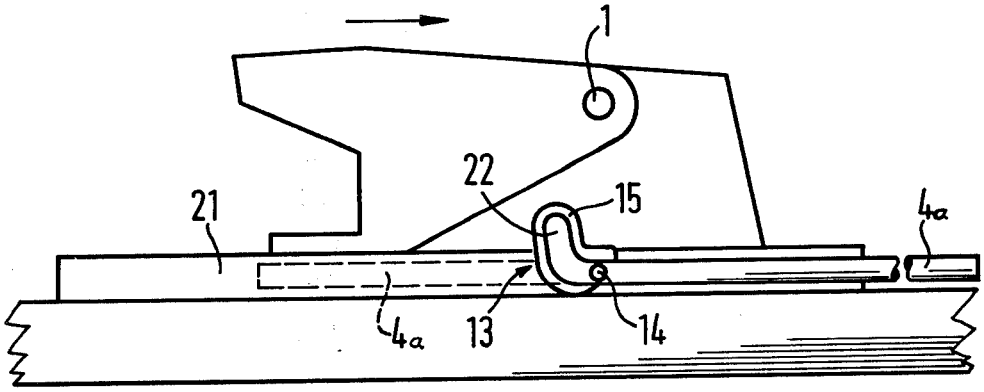
FIGS. 3 and 4 are similar views of a second embodiment of the ski brake in accordance with the present invention.
Figure 4:
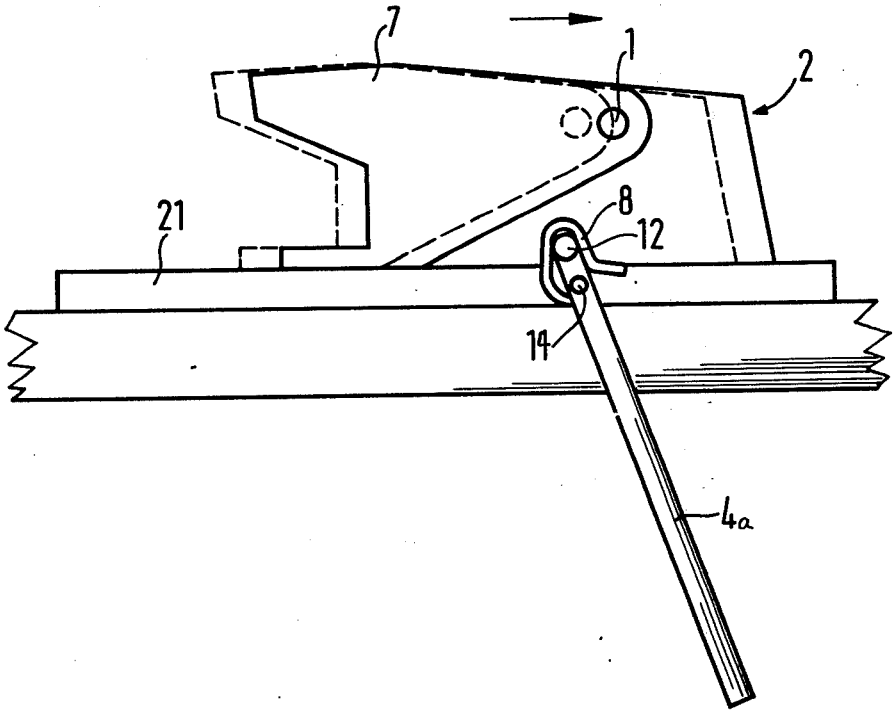

The arrangement shown in FIGS. 3 and 4 again has a heel clamp 2 mounted on a support plate 21. Here braking element **4*a* normally extends backwardly from the heel clamp 2 and has a pivot 14 which is parallel to the upper surface of the ski and perpendicular to the normal direction of displacement thereof. A guide 13 has a pair of flanks 15 forming a channel 22 that is of L-shape and open backwardly. A pin 12 parallel to the pin 14 constituting the pivot for the element 4*a* is displaceable along this channel 22 so that as the heel clamp 2** moves backwardly the braking element 4*a* will be displaced from the rest position of FIG. 3 to the braking position of FIG. 2.

It is noted that in this embodiment the heel clamp 2 has a portion 7 which can also pivot upwardly about an axis 1 parallel to the pivot 14.

Figure 6:
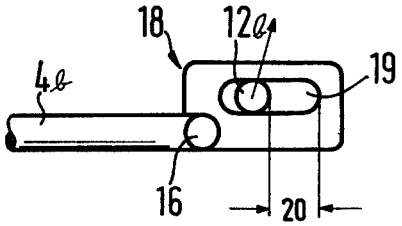
FIGS. 5 and 6 are large-scale views of a detail of a third embodiment of the ski brake.
Figure 5:
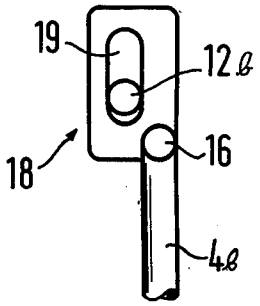

In FIGS. 5 and 6 an arrangement is shown wherein a braking element 4*b* has a pivot 16 and a head piece 18 formed with an elongated slot 19 in which is engaged a guide pin 12*b* carried on one of the toe or heel clamps of a ski. This pin 12*b* can move through a distance 20 parallel to the normal direction of displacement of the ski and to the element 4*b* in the rest position thereof without pivotally moving the element 4*b*. Beyond this region 20, however, the entire element 4*b* will be displaced into the braking position shown in FIG. 5. Of course the relative orientation of the slot 19 and the pivot 16 could be changed in accordance with this invention.

Figure 7:
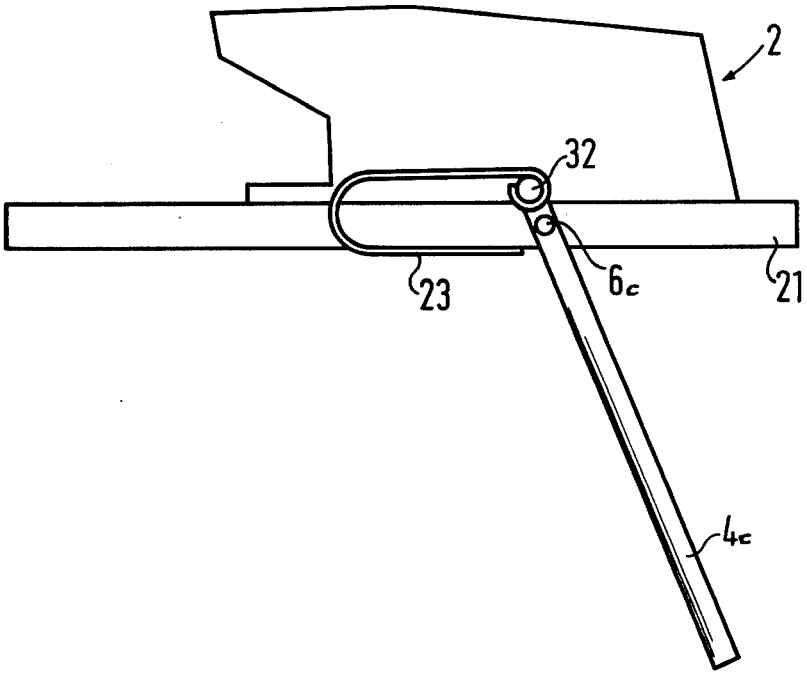
FIG. 7 is a side view of yet another ski brake according to this invention.

FIG. 7 shows schematically how a brake element 4*c* is for instance coupled with a leaf spring 23 in accordance with the invention. The pivot point 4*c* of the element 4*c* is for example arranged on the support plate 21 whereas the spring 23 is also provided on the tip point 32 for receiving force from the heel clamp 2.

Figure 8:
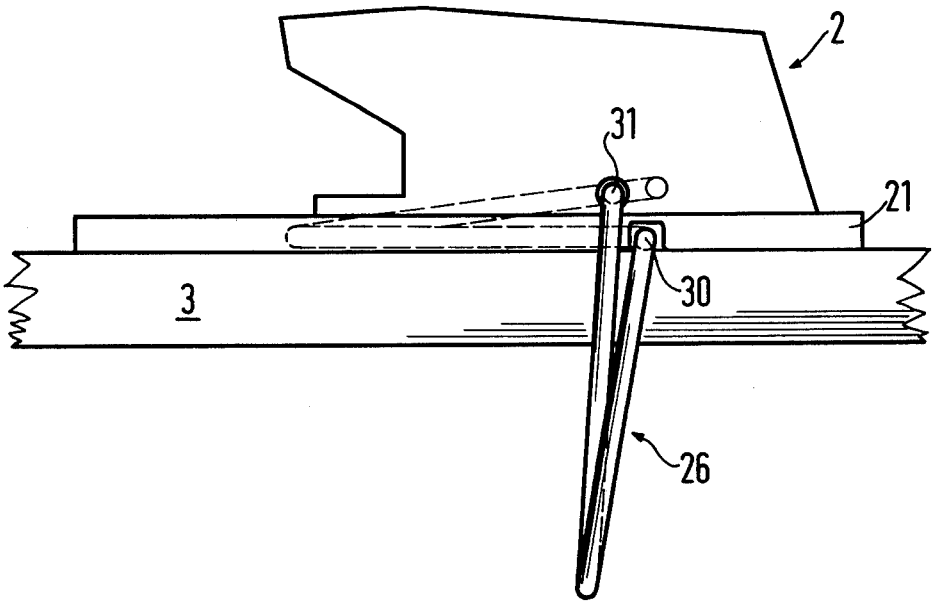
FIGS. 8 and 9 are side and perspective detail views of a fifth embodiment of the ski brake in accordance with the present invention.
Figure 9:
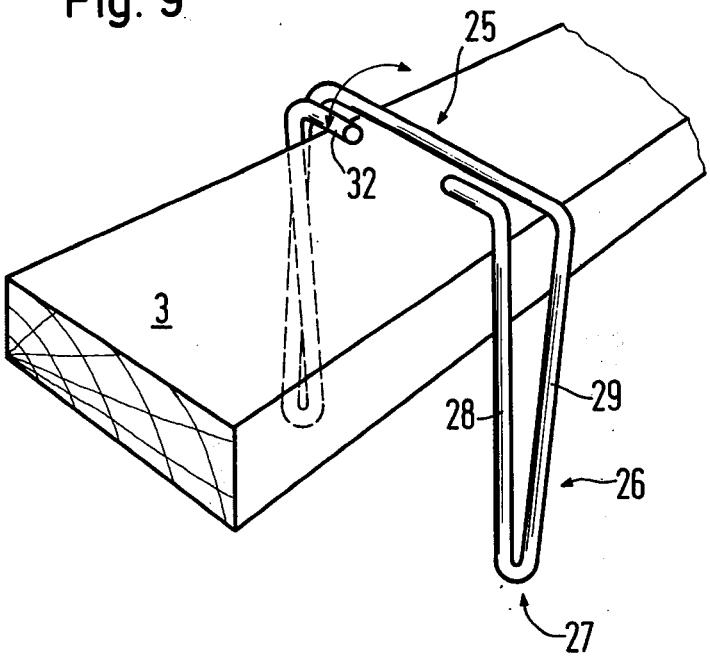

FIGS. 8 and 9 show another arrangement wherein a pair of braking elements 26 of U-shape each have a pair of legs 28 and 29 connected at a bight 27. The free end of the leg 28 is pivoted at 30 in the support plate 21 and the free end of the leg 29 is pivoted at 31 in the heel clamp 2 and join unitarily at 25 to the similar free end of the corresponding leg of the other element. Thus this entire braking element is constituted as a single unitary piece of elastically deformable wire which is prestressed so as normally to lie in the braking position shown in FIGS. 8 and 9. When the heel clamp moves backwardly the pivot 31 moves back over the top of the pivot 30 so as to bend the two brake elements 26 up into the dashed-line braking position shown in FIG. 8. The relative positions of the pivots 30 and 31 can be moved so that either lies ahead of the other. Furthermore their vertical spacing can be increased considerably so as to increase the lever effect of the braking elements when bent down into the braking position.

Furthermore the leg 28 lies inside the leg 29, that is closer to the ski 3. Indeed the entire wire can be coplanar at one point in its motion between its braking and rest positions. Furthermore it is possible for the bight portion 25 to pass either through the heel clamp 2 or the support plate 21 with the two bent-over end sections 32 engaged in the other member.

It will be understood that each of the elements described above, or two or more together, may also find a useful application in other types of structures differing from the types described above.

While the invention has been illustrated and described as embodied in a ski brake, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In combination with an elongated ski and a ski binding having a support part fixed on said ski and toe and heel clamps at least one of which has a clamp part longitudinally displaceable on said ski between a hold position securing a skiboot to said ski and a release position disengaged from a skiboot, a ski brake comprising:

an elongated braking element displaceable on said ski between a rest position extending generally parallel to said ski and a braking position extending transverse to and projecting downwardly beyond a lower surface of said ski, said braking element being an elastically deformable wire of generally U-shape having a pair of legs each with a free end and a bight joining the other ends of said legs, one of said free ends being pivoted in said support part; and means for pivotally connecting the other of said free ends in said clamp part and for displacing said braking element into said braking position on displacement of said clamp part into said release position and for displacing said braking element into said rest position on displacement of said clamp part into said hold position.

2. The ski brake defined in claim 1 wherein said means defines a guide for said braking element.

3. The ski brake defined in claim 2 wherein said other free end has a formation engaging in said guide and movable therewith on displacement of said braking element between said rest and braking positions.

4. The ski brake defined in claim 3 wherein said one free end is provided with a laterally extending projection constituting a pivot engaged in said support part and forming a pivot axis extending transverse to said ski.

5. The ski brake defined in claim 1 wherein said other free ends lie above said one free ends and said wire is prestressed so as normally to lie in said braking position.

6. The ski brake defined in claim 5, wherein a pair of such wires have their other free ends joined unitarily together and extending through said clamp part.

7. A ski brake for use with an elongated ski and a ski binding adapted to removably hold a skiboot and movable on the ski, comprising:

an elongated braking element adapted to be displaceable relative to the ski between a rest position in which it extends generally parallel to the ski and a braking position in which it projects downwardly below a lower surface of the ski, said braking element having at least two elongated arms each having a free end portion; and means connecting said braking element to the ski for displacement from said braking position into said rest position in response to engagement of a skiboot with the ski binding, and for displacement from said rest position into said braking position in response to disengagement of the skiboot from the ski binding, said means mounting one of said free end portions for pivotal movement on a first pivot axis which extends transverse of the ski and is stationary relative thereto, and said means mounting another of said free end portions for pivotal movement on a second pivot axis substantially parallel to the first pivot axis and for translatory movement longitudinal of the ski and normal to said first pivot axis in response to movement of said ski binding on disengagement of the skiboot.

* * * * *